United States Patent [19]

Kylmänen

[11] Patent Number: 4,565,327

[45] Date of Patent: Jan. 21, 1986

[54] APPARATUS FOR PIECE-CHOPPING WOOD

[75] Inventor: Pasi Kylmänen, Liminka, Finland

[73] Assignee: Kopo Konepohja Oy, Finland

[21] Appl. No.: 148,060

[22] Filed: May 8, 1980

[30] Foreign Application Priority Data

May 10, 1979 [FI] Finland ..... 791491

[51] Int. Cl.[4] ..... B02B 1/00

[52] U.S. Cl. ..... 241/56; 241/260.1

[58] Field of Search ..... 241/56, 82.5, 247, 260.1; 144/176, 162 R

[56] References Cited

U.S. PATENT DOCUMENTS

| | | | |
|---|---|---|---|
| 1,039,610 | 9/1912 | Straub | 241/260.1 |
| 3,000,411 | 9/1961 | Ealet | 144/176 |
| 3,102,694 | 9/1963 | Frenkel | 241/260.1 X |
| 3,189,286 | 6/1965 | O'Connor | 241/56 |
| 3,304,970 | 2/1967 | Altosaar | 144/176 X |
| 3,968,998 | 7/1976 | Wolf | 241/260.1 X |
| 4,053,004 | 10/1977 | Barwise et al. | 144/162 R |

FOREIGN PATENT DOCUMENTS

| | | | |
|---|---|---|---|
| 858071 | 11/1940 | France | 144/176 |

*Primary Examiner*—James G. Smith

*Attorney, Agent, or Firm*—Steinberg & Raskin

[57] ABSTRACT

Apparatus for piece-chopping wood includes rotary blade apparatus accommodated within a housing including a helical, screw-like blade member having a conical outer configuration which increases in diameter in the direction in which the wood is fed, the outer edge of the helical blade member being shaped to function as a cutting blade whereby wood fed through a feed hopper into the housing is chopped into relatively large size pieces which are then discharged through a tube communicating with the housing. The housing has an interior fluted guiding surface which is associated with the blade member whereby the wood fed thereto is drawn inwardly towards the blade. At least one counter-blade may be fixed to the interior surface of the housing in the region of the outer edge of the blade member.

8 Claims, 7 Drawing Figures

APPARATUS FOR PIECE-CHOPPING WOOD

BACKGROUND OF THE INVENTION

This invention relates generally to apparatus for chopping wood and, more particularly, to wood chopping apparatus comprising a feed hopper into and through which tree members to be chopped are fed, a housing for accommodating rotary blade apparatus, a discharge tube through which the chopped wood pieces are discharged from the apparatus and rotary blade apparatus disposed within the housing.

One of the consequences of the continuous and rapid increases in the price of oil has been the increased use of solid fuels such, for example, as wood chips, peat, etc., in connection with the generation of heating energy. In this connection, several types of apparatus are known for manufacturing chipped wood. Such known and conventional wood chipping apparatus generally incorporate a rotating, drum-like blade apparatus which operates as a cutting blade to which the wood material to be chopped is introduced by means of separate feeding apparatus. Such conventional wood chippers generally require relatively high power input and, consequently, the production of chipped wood is a relatively expensive operation.

Further, it is generally recognized that wood chips having a relatively large size, i.e., so-called piece-chopped wood, is better suited for use in connection with the generation of heating energy by virtue of its geometrical properties than the common smaller variety of chipped wood. More particularly, piece-chopped wood is generally better suited for heat generation than conventional chipped wood in that piece-chopped wood will dry more completely and in a shorter time when stored in a heap or pile since a better circulation of air can be accomplished between the piece-chopped wood which comprises lump-like wood pieces which inherently provides spaces therebetween when stored in a heap through which air can circulate. In contrast, however, conventionally chipped wood comprising smaller wood pieces, when piled in a heap or the like, tends to become densely or closely packed thereby inhibiting the circulation of drying air therethrough so that such conventional chipped wood remains damp even after long periods of time. Of course, the damp chipped wood presents difficulties when used as a fuel resulting in increased costs with respect to its firing and, further, provides reduced calorific content.

SUMMARY OF THE INVENTION

Accordingly, one object of the present invention is to provide new and improved apparatus for piece-chopping wood.

Another object of the present invention is to provide new and improved apparatus for piece-chopping wood wherein separate apparatus for feeding the wood into the apparatus is not required, i.e., wherein the apparatus itself is adapted to draw a tree or tree member to be chopped into itself in a reliable and efficient manner.

Still another object of the present invention is to provide new and improved apparatus for piece-chopping wood having relatively low power requirements.

Briefly, in accordance with the present invention, these and other objects are attained by providing apparatus including rotatable blade apparatus which include a helical, screw-like blade member having a conical outer configuration which increases in diameter in the direction in which the wood is fed thereinto and wherein the outer edge of the helical blade member is shaped to function as a cutting blade.

The rotatable blade apparatus is located within a housing with which a feed hopper is associated into and through which the wood to be chopped is fed into the housing. A discharge tube having one end which communicates with the housing is provided through which the chopped wood pieces are discharged from the apparatus.

Preferably, the housing which accommodates the rotary blade apparatus is formed with a fluted or grooved interior guiding surface which is formed in close cooperating relationship with the helical blade member so that wood to be chopped which is fed through the feed hopper is engaged by the blade member against the fluted guiding surface so that the fluted guiding surface simultaneously aids the chopping and further feeding of the wood while preventing the latter from withdrawing from the housing. Thus, the blade apparatus not only functions to piece-chop the wood but, additionally, acts to draw the wood to be chopped into the apparatus thereby eliminating the need for separate wood feeding apparatus.

By providing the geometry of the blade member of the blade apparatus to be within certain specified ranges, the power requirements, size of the piece-chopped wood as well as the capability of the apparatus to provide a self-feed of the wood can be suitably adjusted.

The apparatus for piece-chopping wood of the present invention provides several significant advantages relative to conventional wood chopping apparatus. Thus, as noted above, the piece-chopper apparatus of the invention can draw the tree or tree members to be chopped into the apparatus in a reliable and efficient manner without the necessity of separate feeding apparatus. Secondly, the power requirements of the apparatus of the present invention are relatively low. Additionally, the apparatus of the present invention in simple and economical in construction, and is relatively light in weight so as to render the same suitable for use in various applications such, for example, on a farm or the like.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENT

Figure 1:
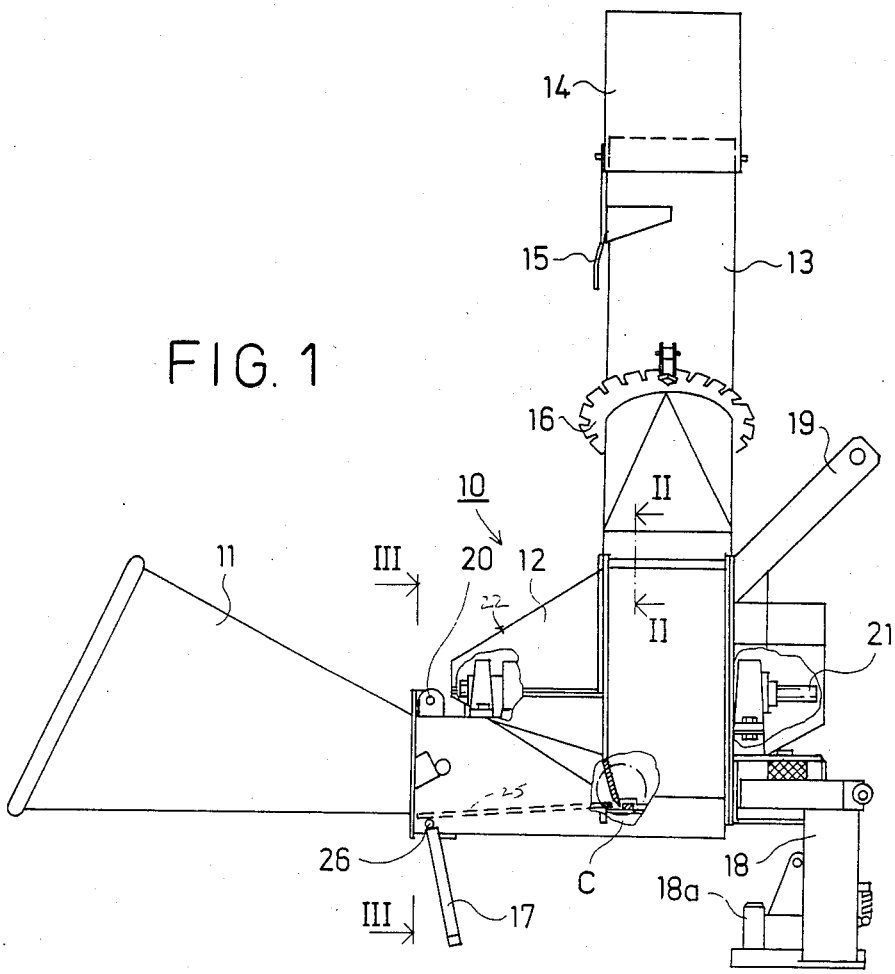
FIG. 1 is a side elevation view of one embodiment of the piece-chopper apparatus of the present invention.

Referring now to the drawings wherein like reference characters designate identical or corresponding parts throughout the several views and more particularly to FIG. 1, the illustrated embodiment of the piece-chopper apparatus of the present invention, generally designated 10, comprises a housing 22 in which rotary blade apparatus, described below, is accommodated, a feed hopper 11 having one end which communicates with the housing 22, and a discharge tube 13 which also communicates at one end with the housing 22. Thus, trees or tree members such, for example, as large branches or the like, are fed through the hopper 11 into the housing 22 where the same is piece chopped, the wood pieces being discharged in a manner described below from the housing 22 through the discharge tube 13.

The housing 22 includes a blade chamber guard 12 which defines the chamber within housing 22 in which the rotary blade apparatus is accommodated. A deflection plate 14 is pivotally secured to the upper end of the discharge tube 13 and is adjustably positioned thereon by means of a regulating arm 15. A regulating flange 16 is also provided on the discharge tube 13.

The piece-chopper apparatus 10 during operation is supported by a pair of front legs 18 and a single rear leg 17, each of which is pivotally secured to housing 22. A trailer hitch 18*a* is associated with the front legs 18 so that the apparatus can be conveniently transported to a desired site. In this connection, an elongate bracket 19 has one end fixed to the housing 22 and the rear leg 17 is pivotally mounted to the housing 22 by means of a pivot pin 26 so that during transportation, the rear leg 17 can be pivoted against the bottom of the housing 22.

As noted above, blade apparatus, generally designated 21, is rotatably mounted within housing 22, FIG. 1 illustrating a shaft forming a part of the blade apparatus 21 which is rotatably mounted in suitable bearing blocks.

Figure 3:
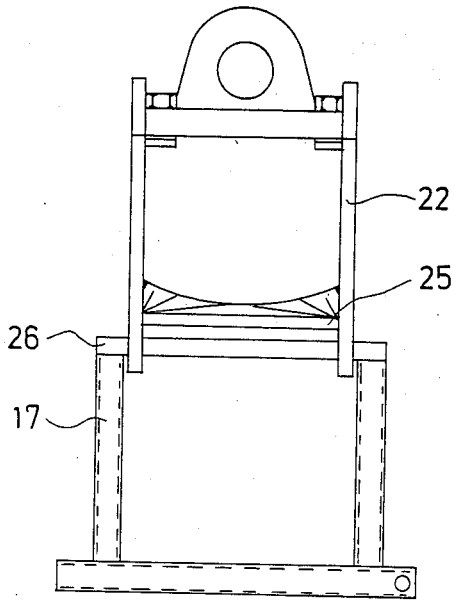
FIG. 3 is a schematic section view taken along line III—III of FIG. 1.

Referring to FIGS. 1 and 3, a bottom plate 25 is provided in the lower interior portion of housing 22 below the blade apparatus 21 located within the blade chamber guard 12. The bottom plate 25 is preferably adjustably positioned and is slightly inclined in the forward or feeding direction.

Figure 7:
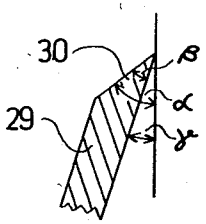
FIG. 7 illustrates in an enlarged scale a detail view of the blade member illustrated in FIG. 6.
Figure 6:
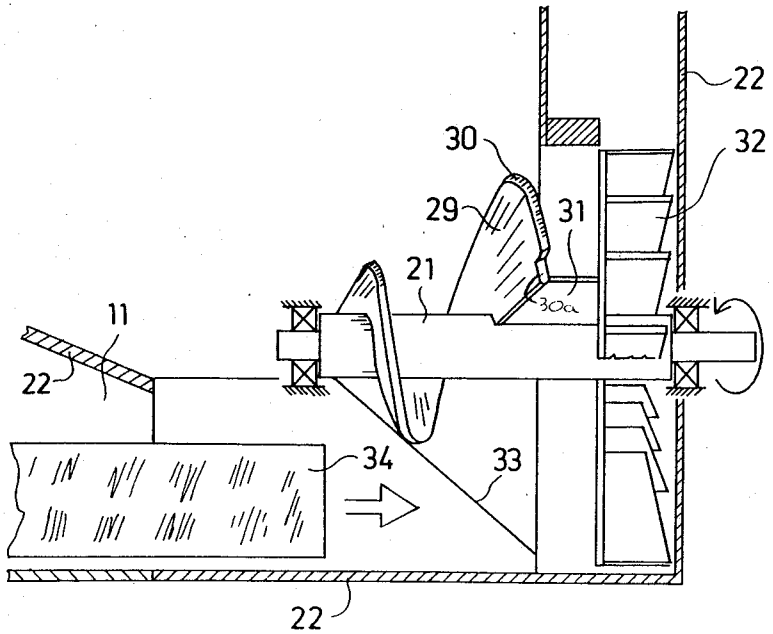
FIG. 6 is a schematic side elevation view illustrating the components of the present invention during operation.

Turning now to FIG. 6, the blade apparatus 21 of the present invention is illustrated in connection with the abovedescribed components of the apparatus which are shown in a schematic fashion. More particularly, the blade apparatus 21 comprises a shaft rotatably mounted at its ends in a pair of bearing blocks and to which a helical, screw-like blade member 29 is fixed. The blade member 29 has a conical outer configuration which increases in diameter in the direction in which the wood is fed into the housing 22 as designated by the arrow in FIG. 6. Thus, the axis of the helical blade member 29 is coincident with the axis of rotation of the blade apparatus 21 and extends in substantially the same direction as that in which the wood to be chopped is fed into the housing. The imaginary cone defined by the helical blade member 29 preferably has a taper angle of about 60°. The outer edge of the helical blade member 29 is beveled as best seen in FIGS. 6 and 7 so as to define a cutting blade 30. It will be understood that the helical blade member 29 is accommodated within the blade chamber guard 12 of the housing 22.

The terminal portion of the cutting blade 30 of the blade member 29 is notched at 30*a* and a so-called flinger vane 31 extends in a plane containing the axis of rotation of and radially from the rotatably shaft of the blade apparatus 21, the forward radially extending edge thereof being fixed to the rearwardly facing surface of the blade member 29 at its terminal edge. During operation of the apparatus, the flinger vane 31 functions to throw the chopped pieces of wood from the housing 22 into the discharge tube 13.

Blower apparatus 22 are mounted on the rotatable shaft rearwardly of blade member 29 so as to rotate within housing 22 when the blade apparatus 21 is rotated. The blower apparatus 32 serves to further direct the cut pieces of wood out from housing 22 into the discharge tube 13 during operation.

A fluted or groove-like guiding surface, schematically designated as 33 (FIG. 6), is provided which cooperates with the blade apparatus 21 to simultaneously accomplish the feeding and chopping of the wood material 34 and, additionally, to prevent the wood material from withdrawing from the housing 22 during the cutting operation. More particularly, the fluted or groove-like guide surface 33 is formed at the interior surface of the housing 22 in close cooperating relationship with the cutting blade 30 of the helical blade member 29, the line 33 in FIG. 6 designating the guide surface illustrating the edge of the groove of the surface. In this connection, the angle of taper of the helical blade member 29 will determine the angular orientation of the fluted guide surface 33 as seen in FIG. 6.

Figure 4:
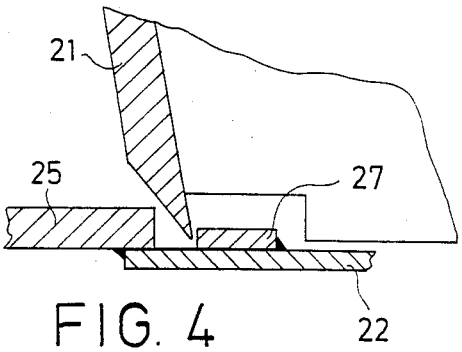
FIG. 4 is a view in an enlarged scale of the detail designated C of FIG. 1.

Referring to FIG. 4, a metallic cut-off strip 27 is affixed to the lower portion of housing 22 just rearwardly of the blade chamber guard 12 so that the forward edge of the same is in close cooperating relationship with the cutting blade 30 of blade apparatus 21. Thus, the strip 27 functions as a main counter-blade so that as the wood material is fed into the apparatus, wood pieces of a given length are chopped between the cutting blade 30 and the cut-off strip 27.

Figure 2:
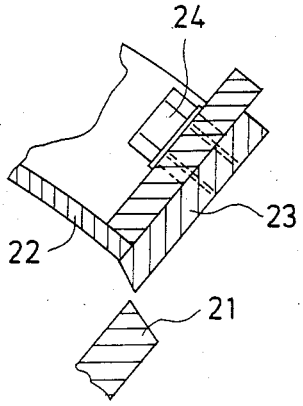
FIG. 2 is a partial view in section taken along line II—II of FIG. 1.

Further, referring to FIG. 2, additional counter-blades 23 are mounted along the inner surface of the housing 22 in cooperating relationship with the blade member 29. More particularly, each counter-blade 23 is affixed to the housing 22 by conventional fastening means such, for example, as a hex head bolt 24. These counter-blades 23 function to chop wood members such as sticks, branches, etc. into relatively long pieces before the same enter into the discharge tube 13.

Figure 5:
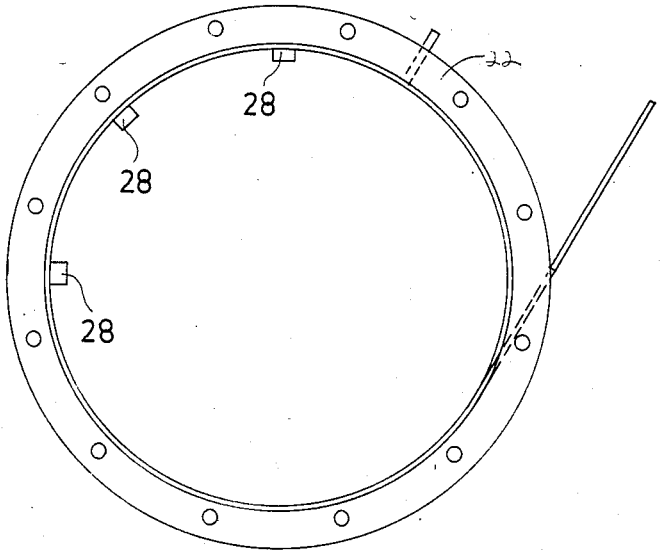
FIG. 5 illustrates a front view of one embodiment of a housing for use in connection with the present invention and illustrating the use of counter-blades.

In the embodiment of the housing illustrated in FIG. 5, three counter-blades 28 are provided on the inner surface of housing 22. The counter-blades 28 have the same function as the additional counter-blades 23 illustrated in FIG. 2. It is understood that the apparatus 10 may be provided with additional counter-blades 23 or 28, the actual number being determined by the particular application to which the apparatus is put.

Referring now to FIG. 7, certain important geometric parameters of the blade member 29 of the blade apparatus 21 are illustrated. Thus, a so-called blade angle designated $\alpha$, is defined between the tip of the cutting blade 30 of the blade member 29 and a plane which is substantially normal to the axis of rotation of the blade apparatus 21. The magnitude of the blade angle $\alpha$ is preferably within the range of about 40° to about 45°. The angle $\beta$ defines the angle between the beveled surfaces of the cutting blade 30 and is preferably about 37°. The angle of inclination $\alpha$ defined between the rear surface of blade member 29 and the plane extending normal to the axis of rotation of the blade apparatus preferably is within the range of about 3° to about 8°. This angle of inclination $\alpha$ preferably increases from a minimum at the forward end of the helical blade member 29 to the rearward end thereof, i.e., in the direction in which the blade apparatus 21 feeds the wood material 34.

In operation, it is advantageous to utilize as a power source for the rotary blade apparatus any power equipment generally found on farms or forest holdings, such as a tractor. Wood material 34 (FIG. 6) is fed through the feed hopper 11 whereupon it engages the fluted guide surface 33. Since the helical blade member 29 has a conical configuration, the wood material is not yet contacted by the blade member 29 when the same reaches the fluted guide surface. As the wood material is further urged inwardly, it will at some point be engaged by the cutting blade 30 of blade apparatus 21. Thus, the wood material 34 will be impacted between the cutting blade 30 and the fluted guide surface 33 whereupon the helical configuration of the blade member 29 will cause the wood material to be drawn in the forward direction. Further, the edge of the fluted guide surface 33 prevents the wood material from withdrawing during the chopping operation. In this manner, the wood material 34 which may comprise a tree or tree part, is cut in a crosswise direction and at least partly split.

It is noted that the manner in which the wood material is chopped depends to a large extent on the pitch, diameter and conical taper of the blade apparatus 21 so that the size of the chopped wood pieces can be varied as desired. Further, by suitably varying these parameters, the power requirements of the apparatus 10 can be varied as desired as well as the output thereof.

After the wood material 34 is chopped as described above, the flinger vane 31 together with the blower apparatus 32 cooperate to remove the piece-chopped wood from the apparatus 10 through the discharge tube 13.

The power requirements of the apparatus of the present invention are relatively low compared to conventional apparatus of this type and, therefore, the apparatus of the present invention is particularly suited for use as an accessory to conventional tractors while still providing a sufficiently high capacity for substantially all applications.

Referring again to the geometrically parameters illustrated in FIG. 7, a reduction in the blade angle $\alpha$ provides a consequent increase in the power requirements of the apparatus. However, the length of the choppings will also be increased by such a modification. As a further consequence of a reduction in the blade angle $\alpha$, the force with which the wood material is drawn into the apparatus is also increased. On the other hand, when the blade angle $\alpha$ is increased, the power requirements of the apparatus will be reduced while, simultaneously, the chopped pieces will become smaller and the force with which the wood material is drawn into the apparatus will decrease.

It is seen from the above, that the piece-chopper apparatus of the present invention eliminates the requirement of separate wood material feeding apparatus since the same accomplishes this function through the rotating blade apparatus. Further, the particular construction of the apparatus of the present invention and, in particular, the use of blade apparatus including a helical, screw-like blade member having a conical outer configurations significantly reduces the power requirements relative to conventional apparatus of this type.

Obviously, numerous modifications and variations of the present invention are possible in the light of the above teachings. It is therefore to be understood that within the scope of the appended claims, the invention may be practiced otherwise than as specifically disclosed herein.

What is claimed is:

1. Apparatus for piece-chopping wood comprising:

a housing for accommodating rotary blade apparatus therein;

a discharge tube having one end communicating with said housing and through which the chopped wood pieces are discharged from said apparatus;

a feed hopper having one end communicating with said housing and through which wood to be chopped is fed in a feed direction into said housing;

blade apparatus rotatably mounted within said housing, said blade apparatus including a helical, screw-like blade member having a conical outer configuration which increases in diameter in the direction in which the wood is fed into said housing, the axis of said helix comprising the axis of rotation of said blade apparatus extending in substantially the same direction as said feed direction in which wood to be chopped is fed into said housing from said feed hopper and wherein the outer edge of said helical blade member is shaped to function as a cutting blade;

a fluted guide surface provided in close cooperating relationship with said screw-like blade member such that wood to be chopped which is fed through said feed hopper is engaged by said blade member and against said fluted guide surface so that said guide surface simultaneously aids in the chopping and further feeding of the wood while preventing the latter from withdrawing from the housing; and wherein said helical blade member defines an angle of inclination with a plane extending normal to the axis of rotation of said blade apparatus, said angle of inclination increasing in the direction in which the wood to be chopped is being fed.

2. Apparatus as recited in claim 1 wherein said angle of inclination is in the range of about 3° to about 8°.

3. Apparatus as recited in claim 1 wherein said outer edge of said helical blade member defines a blade angle with a plane extending normal to the axis of rotation of said blade apparatus and wherein said blade angle is in the range of about 40° to about 45°.

4. Apparatus as recited in claim 1 wherein said blade apparatus is provided with a flinger vane which functions to throw the piece-chopped wood into said discharge tube.

5. Apparatus as recited in claim 1 wherein said blade apparatus is fixed to a rotatable shaft and further including blower means fixed to said rotatable shaft for throwing the piece-chopped wood into said discharge tube.

6. Apparatus as recited in claim 1 further including a cross-cutting strip member fixed to the interior surface of said housing in the region of said outer edge of said blade member so that said cross-cutting strip member functions as a main counter-blade to said blade member.

7. Apparatus as recited in claim 1 further including at least one counter-blade fixed to the interior surface of said housing in the region of said outer of said blade member.

8. Apparatus as recited in claim 1 wherein the angle of taper of the cone defined by said helical blade member is about 60°.

* * * * *